US007189089B1

(12) United States Patent
Liao

(10) Patent No.: US 7,189,089 B1
(45) Date of Patent: Mar. 13, 2007

(54) SIDE-ROTATION TRANSFORMING PLUG

(76) Inventor: Sheng-Hsin Liao, No. 10, Alley 38, Lane 229, San Chun St., Shulin (TW)

( * ) Notice: Subject to any disclaimer, the term of this patent is extended or adjusted under 35 U.S.C. 154(b) by 0 days.

(21) Appl. No.: 11/359,592

(22) Filed: Feb. 23, 2006

(30) Foreign Application Priority Data

Jan. 20, 2006 (TW) ..... 95201426 U

(51) Int. Cl.
*H01R 29/00* (2006.01)

(52) U.S. Cl. ..... 439/170; 439/676

(58) Field of Classification Search ..... 439/135, 439/136, 137, 138, 676, 177, 677
See application file for complete search history.

(56) References Cited

U.S. PATENT DOCUMENTS 4,217,019 A * 8/1980 Cameron ..... 439/138
5,372,515 A * 12/1994 Miller et al. ..... 439/138
5,681,187 A * 10/1997 Fukushima et al. ..... 439/700
5,716,224 A * 2/1998 Masuda et al. ..... 439/138
6,045,393 A * 4/2000 Alpert ..... 439/418
6,287,133 B1 * 9/2001 Yang ..... 439/138
7,037,141 B1 * 5/2006 Huang ..... 439/676
2004/0067667 A1 * 4/2004 Kuroki ..... 439/138

* cited by examiner

*Primary Examiner*—Chandrika Prasad
*Assistant Examiner*—Harshad C Patel
(74) *Attorney, Agent, or Firm*—Rosenberg, Klein & Lee

(57) ABSTRACT

A side-rotation transforming plug includes an insulating main body, a plurality of pins and two transforming elements. A plurality of pin slots are located at the front side of the insulating main body. The plurality of pins are located in the pin slots. The two transforming elements are pivoted at the two sides of the insulating main body by a side-rotation method. The two transforming elements can be rotated and adjusted according to the requirements. Thereby, the plug of the present invention makes the insulating main body with a single dimension transform into two formats by using a side-rotation method. Therefore, it is suitable for multiple formats and reduces manufacturing costs. It is very easy to transform the plug's format.

9 Claims, 9 Drawing Sheets

SIDE-ROTATION TRANSFORMING PLUG

BACKGROUND OF THE INVENTION

1. Field of the Invention

The present invention relates to a side-rotation transforming plug. In particular, this invention relates to a plug that is used for connecting a plurality of conducting lines electrically. The side-rotation transforming plug can transform formats according to requirements.

2. Description of the Related Art

Please refer to FIG. 1A and FIG. 1B, which show a plug connecting a plurality of conducting lines electrically of the prior art. The plug can be used for the connection of computers or telephones. At the outside of the insulating main body 10*a* of the plug, there is a buckling element 11*a* having a buckling and positioning function. In the insulating main body 10*a*, there are a plurality of pins 12*a*. The pins 12*a* can move within a short distance in a lengthways direction. When a plurality of conducting lines 20*a* are connected with the plug, the conducting lines 20*a* are plugged from the rear side of the insulating main body 10*a* to make the conducting lines extend into the insulating main body 10*a*. The pin 12*a* stabs into the conducting line 20*a* to make the pin 12*a* electrically connect with conducting line 20*a*.

However, when the plug of the prior art is used for different formats, the insulating main body 10*a* needs different widths a and b. Because the dimension of the insulating main body 10*a* is fixed, the plug of the prior art is only suitable for one format. For example, the insulating main body cannot be suitable for both formats, i.e. 6 PINs and 8 PINs. Therefore, the manufacturer needs to produce different plugs for each format. A mold for insulating the main body with different dimension needs to be developed. The manufacturing costs thereby are increased.

SUMMARY OF THE INVENTION

One particular aspect of the present invention is to provide a side-rotation transforming plug. The plug of the present invention makes the insulating main body with a single dimension transform into two formats via a side-rotation method. Therefore, it is suitable for multiple formats and reduces manufacturing costs. It is very easy to transform the plug's format.

The side-rotation transforming plug includes an insulating main body having a plurality of pin slots in the front side, a plurality of pins located in the pin slots, and two transforming elements that are pivoted at the two sides of the insulating main body by a side-rotation method. The two transforming elements can be rotated backward so that they are located at the first position or rotated forward so that they are located at the second position, and are stacked and installed at the two sides of the insulation main body.

For further understanding of the invention, reference is made to the following detailed description illustrating the embodiments and examples of the invention. The description is only for illustrating the invention and is not intended to be considered limiting of the scope of the claim.

BRIEF DESCRIPTION OF THE DRAWINGS

The drawings included herein provide a further understanding of the invention. A brief introduction of the drawings is as follows.

DETAILED DESCRIPTION OF THE PREFERRED EMBODIMENTS

Figure 1A:
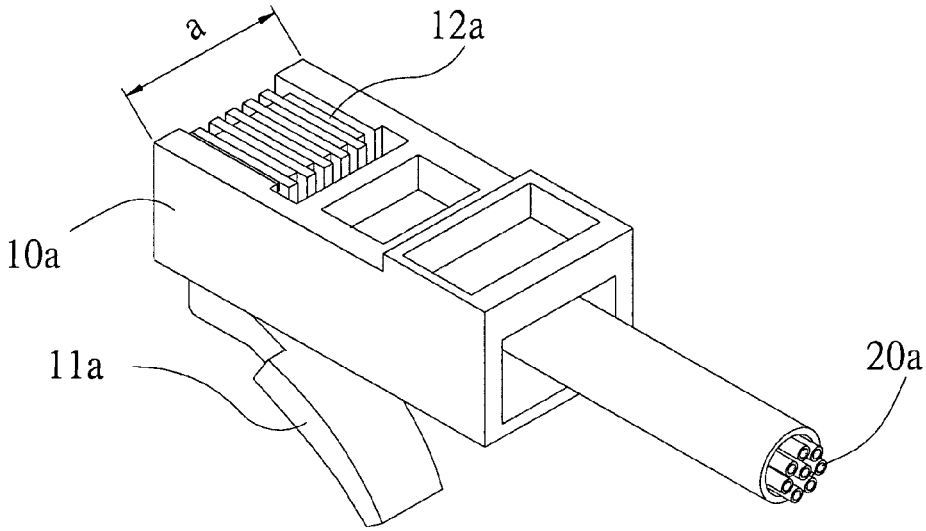
FIG. 1A PRIOR ART
FIG. 1A is a perspective view of a plug of the prior art.
Figure 1B:
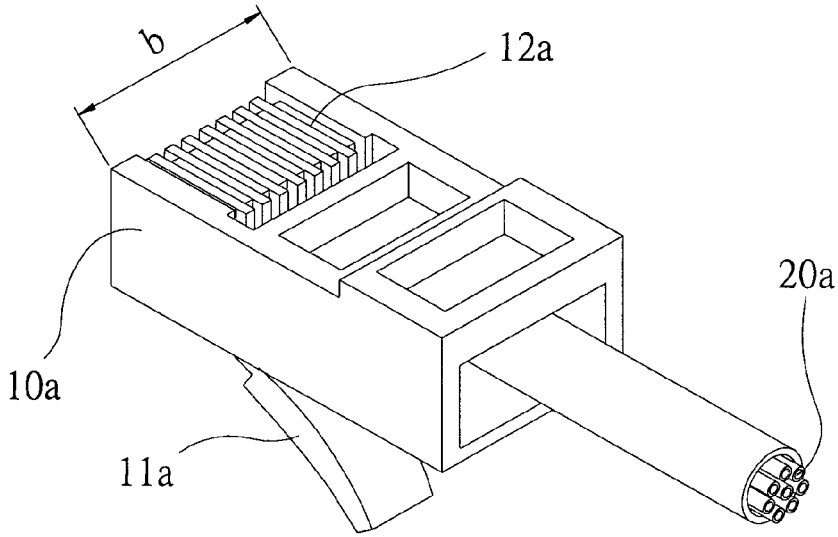
FIG. 1B PRIOR ART
FIG. 1B is a perspective view of another plug of the prior art.
Figure 2:
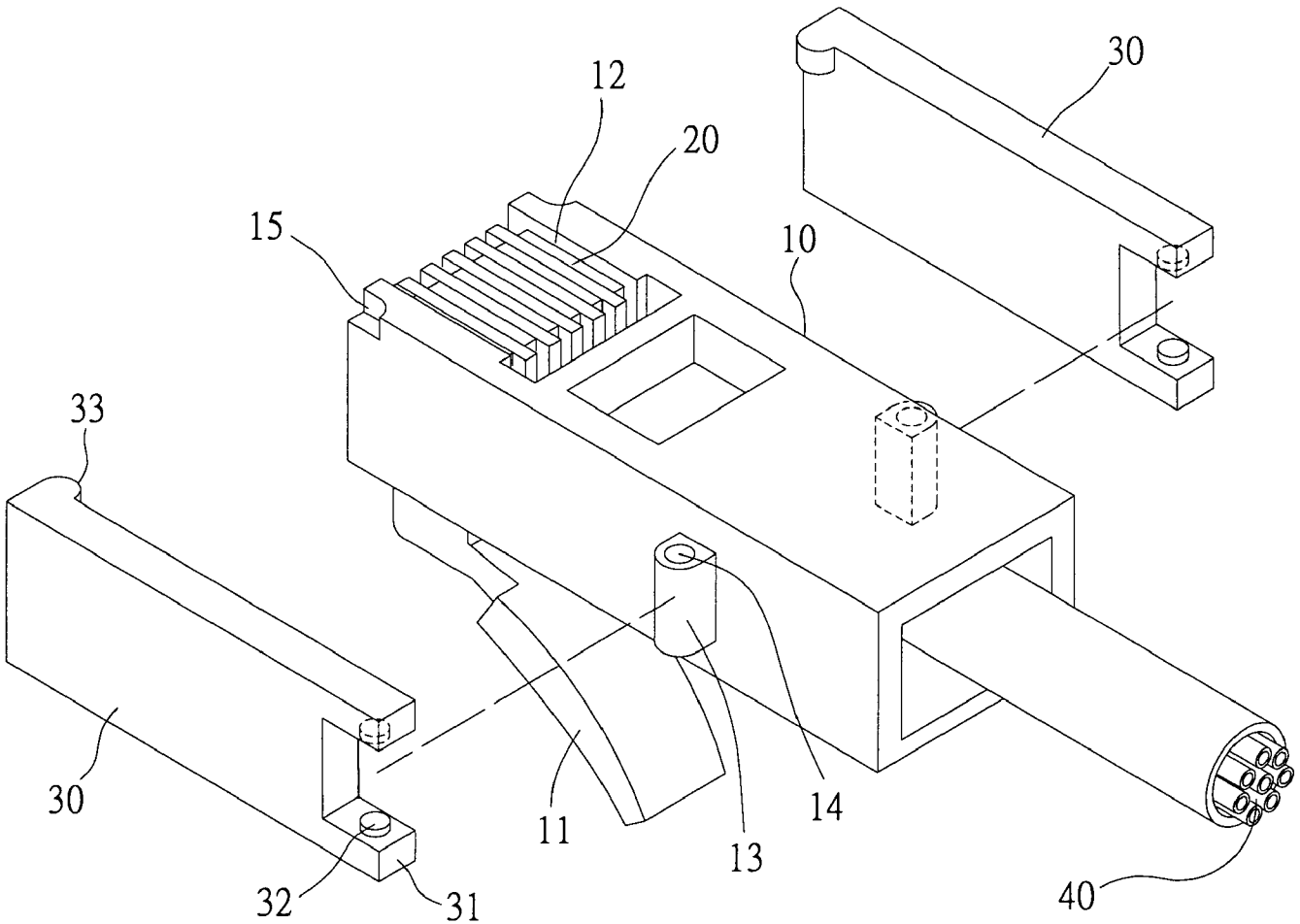
FIG. 2 is an exploded perspective view of the first embodiment of the present invention.
Figure 3:
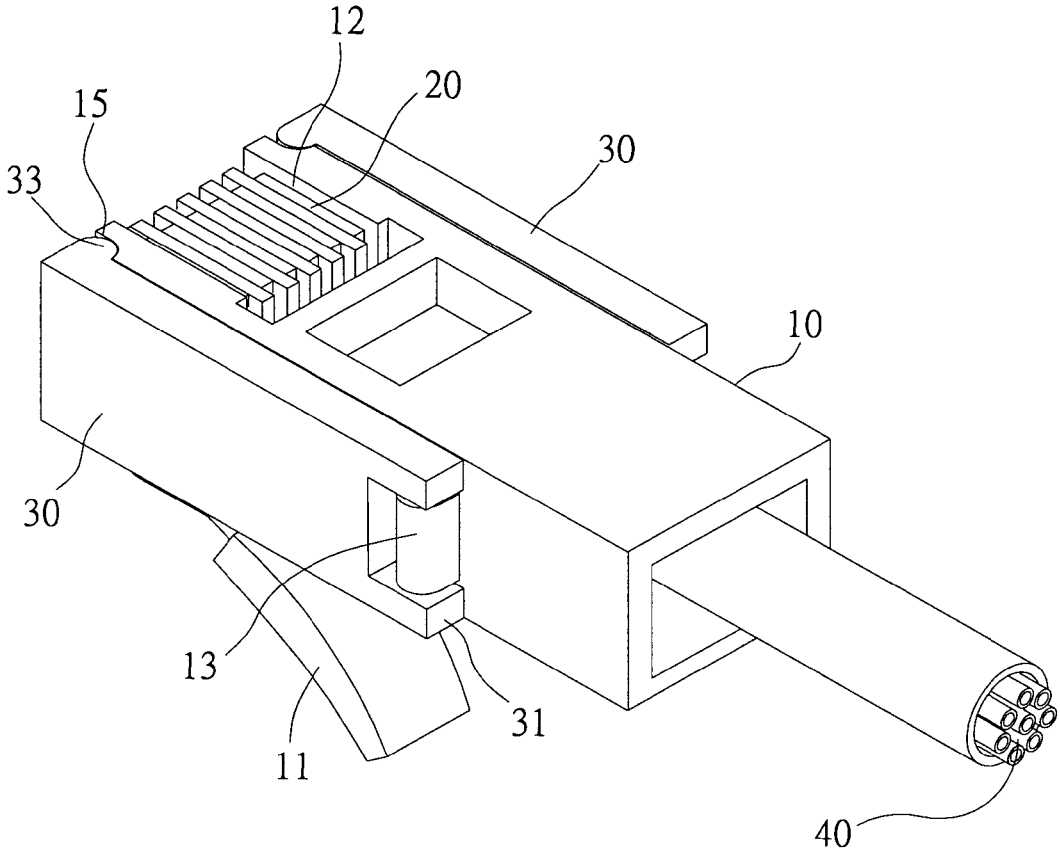
FIG. 3 is a perspective view of the first embodiment of the present invention.
Figure 4:
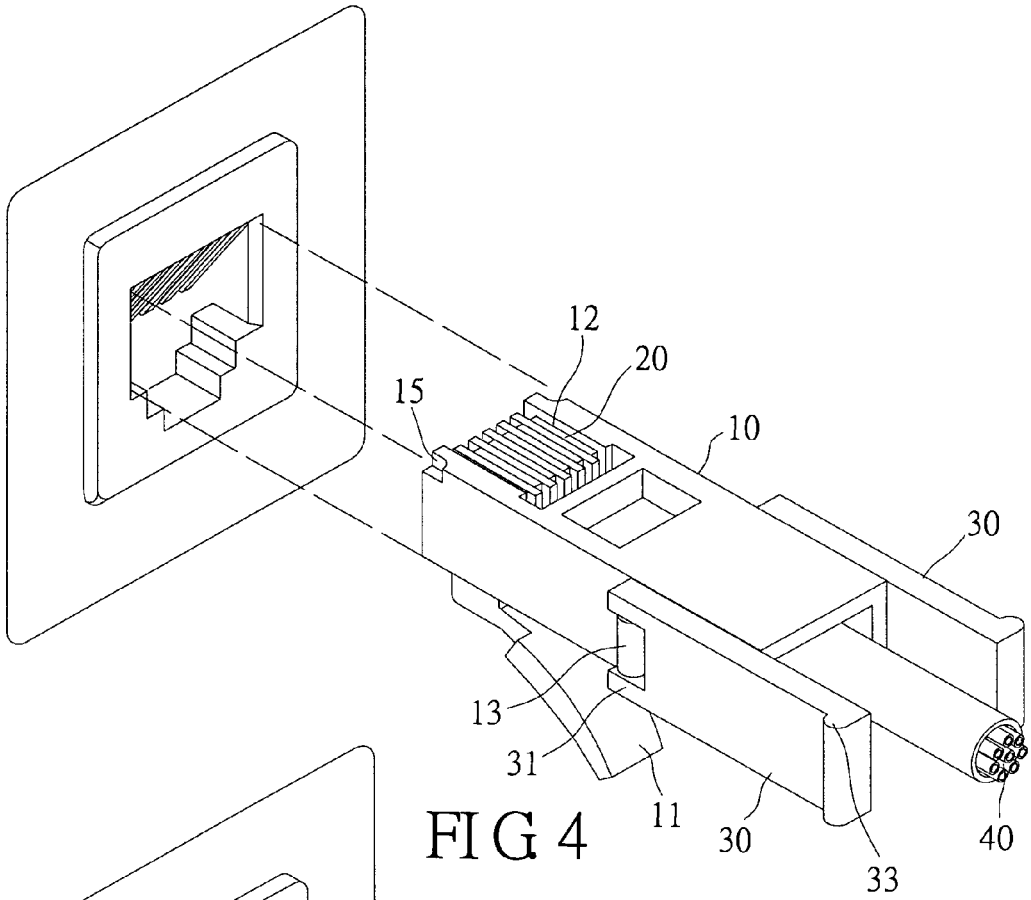
FIG. 4 is a perspective view of the operation status of the first embodiment of the present invention.

Please refer to FIGS. 3 and 4. The present invention provides a side-rotation transforming plug. The side-rotation transforming plug includes an insulating main body 10, a plurality of pins 20, and two transforming elements 30. The insulating main body 10 is made of insulating materials, such as plastic. The inner part of the insulating main body 10 is hollow and the outside of the insulating main body 10 has a buckling element 11 having a buckling and positioning function. At the front side of the insulating main body 10, there are a plurality of pin slots 12. The plurality of pin slots 12 are located at the insulating main body 10 and are disposed equidistant from each other. The pin slots 12 link with the inner part of the insulating main body 10. The number of the pin slots 12 is not restricted. Near the rear side of the two sides of the insulating main body 10, there is a pivoting base 13 protruding from each side. The pivoting base 13 has a pivoting hole 14 that vertically passes through the pivoting base 13.

The pins 20 are made of conducting materials, such as copper. Each pin 20 is located in the pin slot 12 of the insulating main body 10. Each of the pins 20 has a stabbing end which has a sharp shape (not shown in the figure) to achieve the effect of electrically connecting with the plurality of conducting lines 40. The number of the pins 20 is not restricted.

The two transforming elements 30 are made of insulating materials, such as plastic, and are flat and shaped like a board. At the rear side of the transforming element 30, two supporting arms 31 are formed which are separated from each other. In the inner part of each of the two supporting arms 311, a pivoting shaft 32 is protruded. The two transforming elements 30 are pivoted with a pivoting hole 14 of the pivoting base 13 located at the two sides of the insulating main body 10 via the pivoting shaft 32 of the two supporting arms 31. Therefore, the two transforming elements 30 are pivoted with the two sides of the insulating main body 10 using a side-rotation method. The two transforming elements 30 can be adjusted by a side-rotation method according to the requirements. At the front side of the two transforming elements 30, each has a first wedging-buckling part 33. At the front side of each of the two sides of the insulating main body 10, there is a corresponding second wedging-buckling part 15.

When the plug is plugged into a socket with a smaller dimension, the two transforming elements 30 are rotated backward so that they match the smaller dimension and can be plugged into the corresponding socket. When the plug is plugged into a socket with a bigger dimension, the two transforming elements 30 are rotated forward so that they are located at two sides of insulating main body 10. Therefore, the width of the plug is increased so that it matches the socket with a bigger dimension and can therefore be plugged into the corresponding socket.

The conducting lines 40 are plugged from the rear side of the insulating main body 10 and enter the inside of the insulating main body 10. The stabbing end of pin 20 pierce the conducting line 40 to make the pin 20 electrically connect with conducting line 20*a*. Therefore, the side-rotation transforming plug of the present invention is electrically connected with the conducting lines 40.

Figure 5:
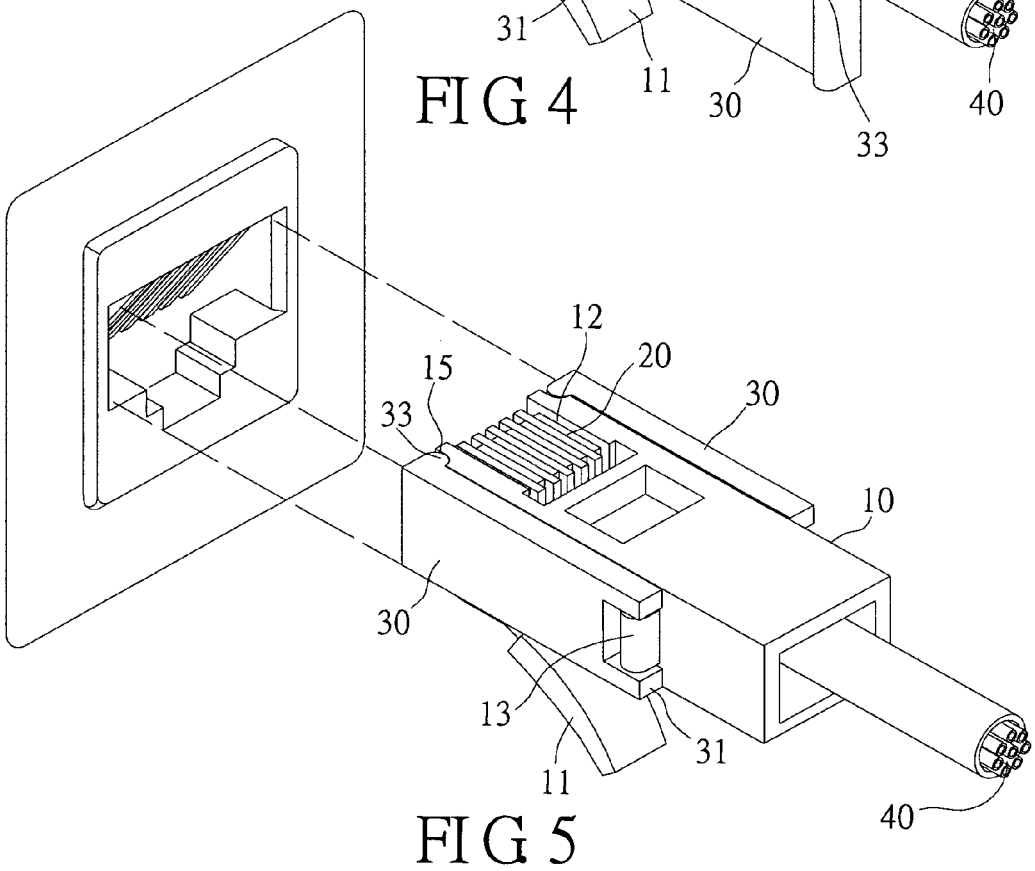
FIG. 5 is a perspective view of another operation status of the first embodiment of the present invention.

The present invention pivots two transforming elements 30 at the two sides of the insulation main body 10. The two transforming elements 30 can be adjusted by a side-rotation method according to requirements. When the two transforming elements 30 are rotated backward so that they are located at the first position, the plug matches the smaller format so that it plugs into the corresponding socket (as shown in FIG. 4). When the two transforming elements 30 are rotated forward so that they are located at the second position, the width of the plug increases to match the bigger format so that they can plug into the corresponding socket (as shown in FIG. 5). When the two transforming elements 30 are rotated forward so that they are stacked and located at the two sides of the insulation main body 10, the first wedging-buckling part 33 is wedged and buckled with the second wedging-buckling part 15 to prevent the two transforming elements 30 from waving.

The prevent invention utilizes the two transforming elements 30 to transform the plug with a single dimension into two formats. Therefore, the side-rotation transforming plug can be applied to the plug with different formats and can also be plugged into the socket with different formats. When the manufacturer produces the plug with two different formats, they therefore do not need to develop two insulating main bodies with different dimensions. Therefore, the plug is suitable for multiple formats and the manufacturing costs are reduced. It is very easy to transform the plug's format.

Figure 6:
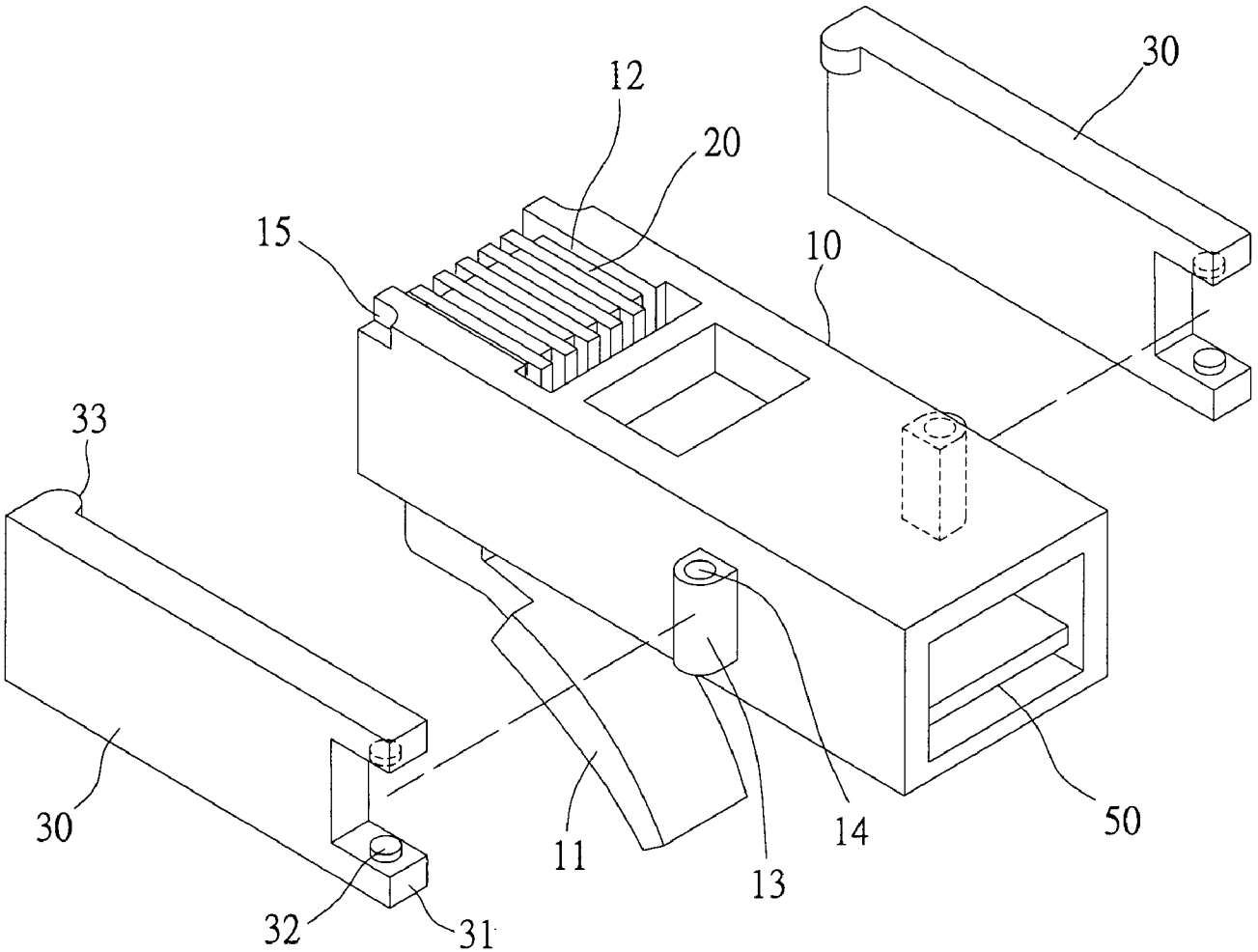
FIG. 6 is an exploded perspective view of the second embodiment of the present invention.
Figure 7:
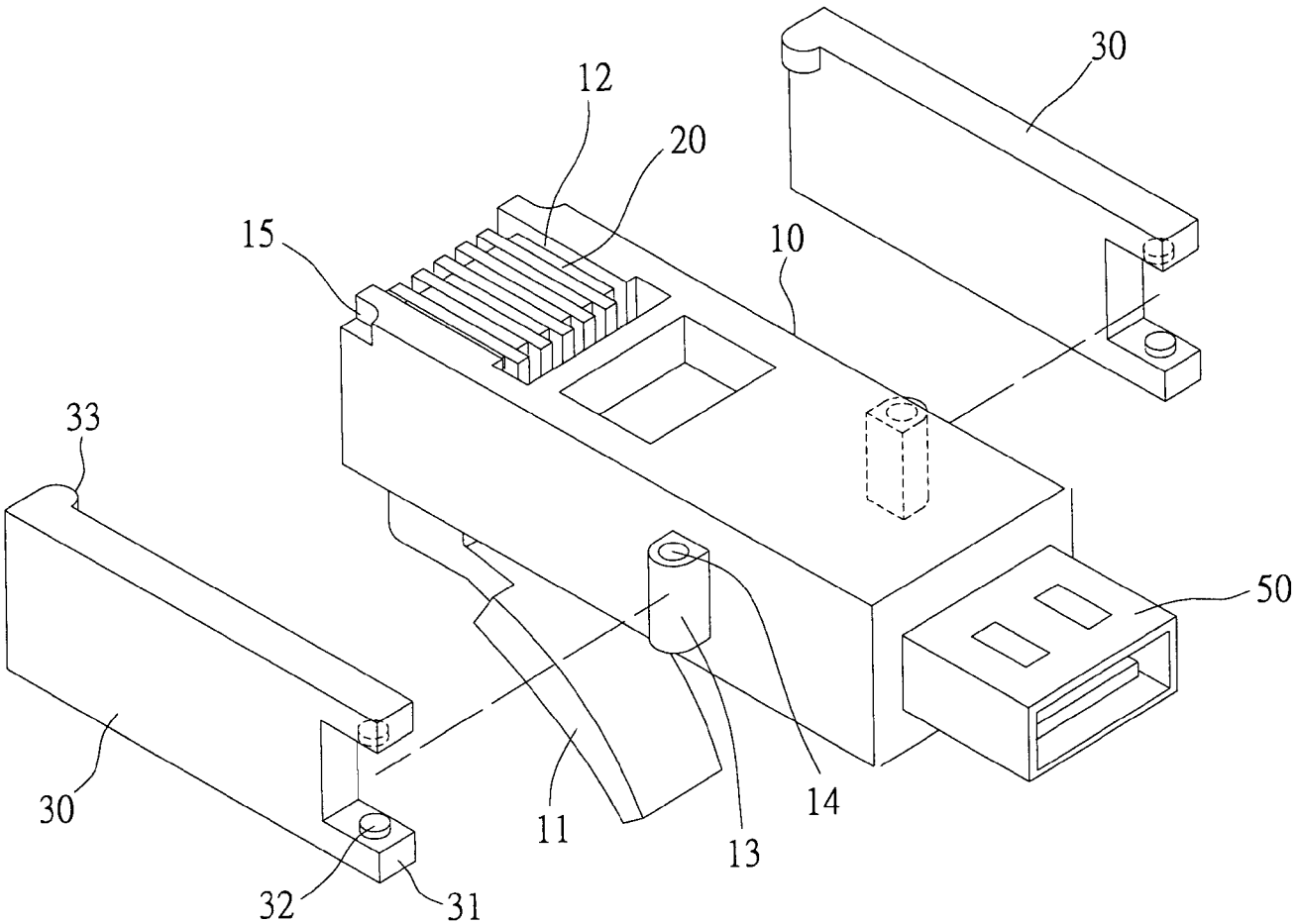
FIG. 7 is another exploded perspective view of the second embodiment of the present invention.

As shown in FIG. 6, at the rear side of the insulating main body 10 of the present invention, a USB connector 50 is connected. The pins 20 are electrically connected with the pins located in the USB connector 50. The USB connector 50 forms a transferring connection element. The USB connector 50 can be a female type (as shown in FIG. 6) or a male type (as shown in FIG. 7). The USB connector 50 also can be replaced by another connector, or a plug and a socket that have other uses.

Figure 8:
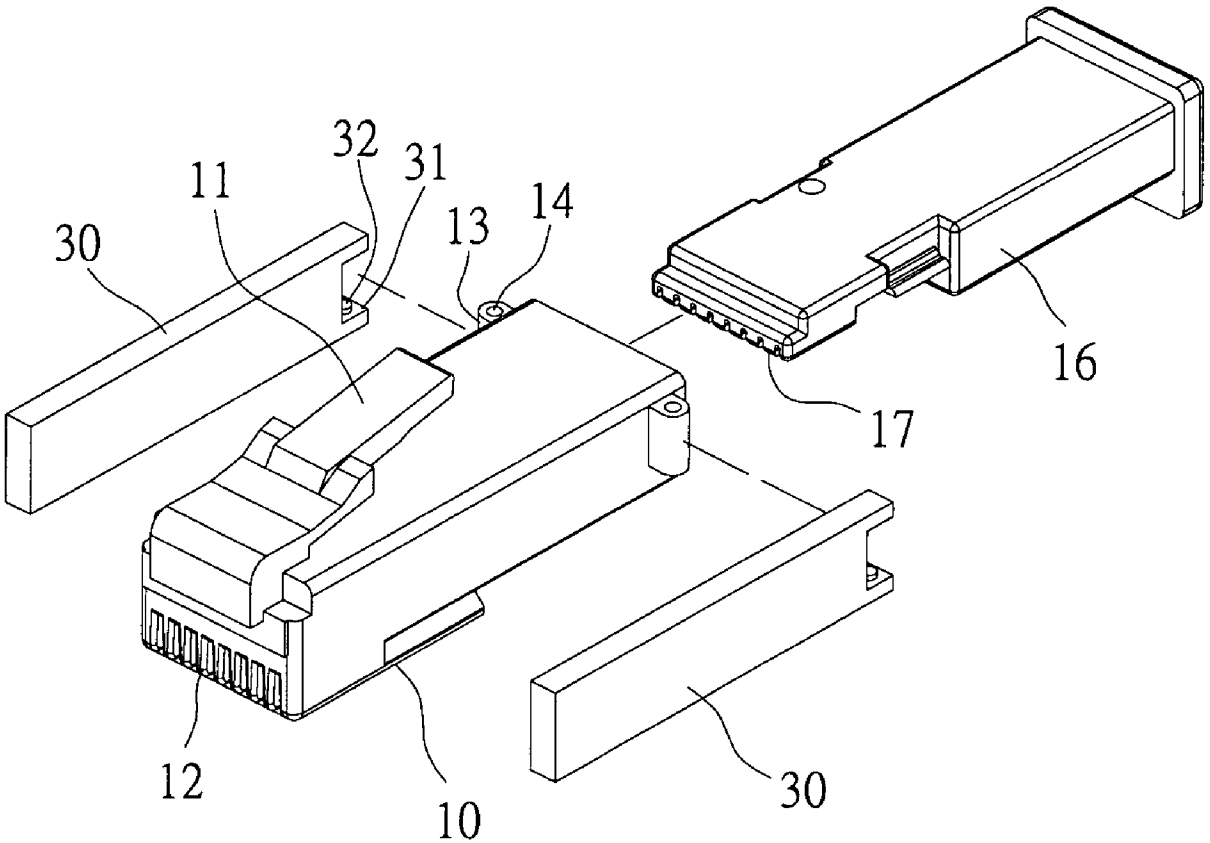
FIG. 8 is an exploded perspective view of the third embodiment of the present invention.

In another embodiment, as shown in FIG. 8, the present invention further includes a linker 16. The linker 16 is made of insulating materials, such as plastic. The conducting lines (not shown in the figure) can pass through the inner part of the linker 16. At the front part of linker 16, there are a plurality of line slots 17. The conducting lines are plugged into the inner part of the line slots from the rear of the linker 16 to make the conducting lines connect with the linker 16 in advance. Then, the linker 16 is plugged from the rear of the insulating main body 10 to make the linker 16 drive the conducting lines to extend into the front end of the inner part of the insulating main body 10. Thereby, the linker 16 and the insulating main body 10 are combined into one piece. Finally, the pins 20 are pressed into the inner part of the pin slots 12 to make the stabbing end of the pins 20 stab into the conducting lines. Therefore, the pins 20 are electrically connected with conducting lines.

Figure 9:
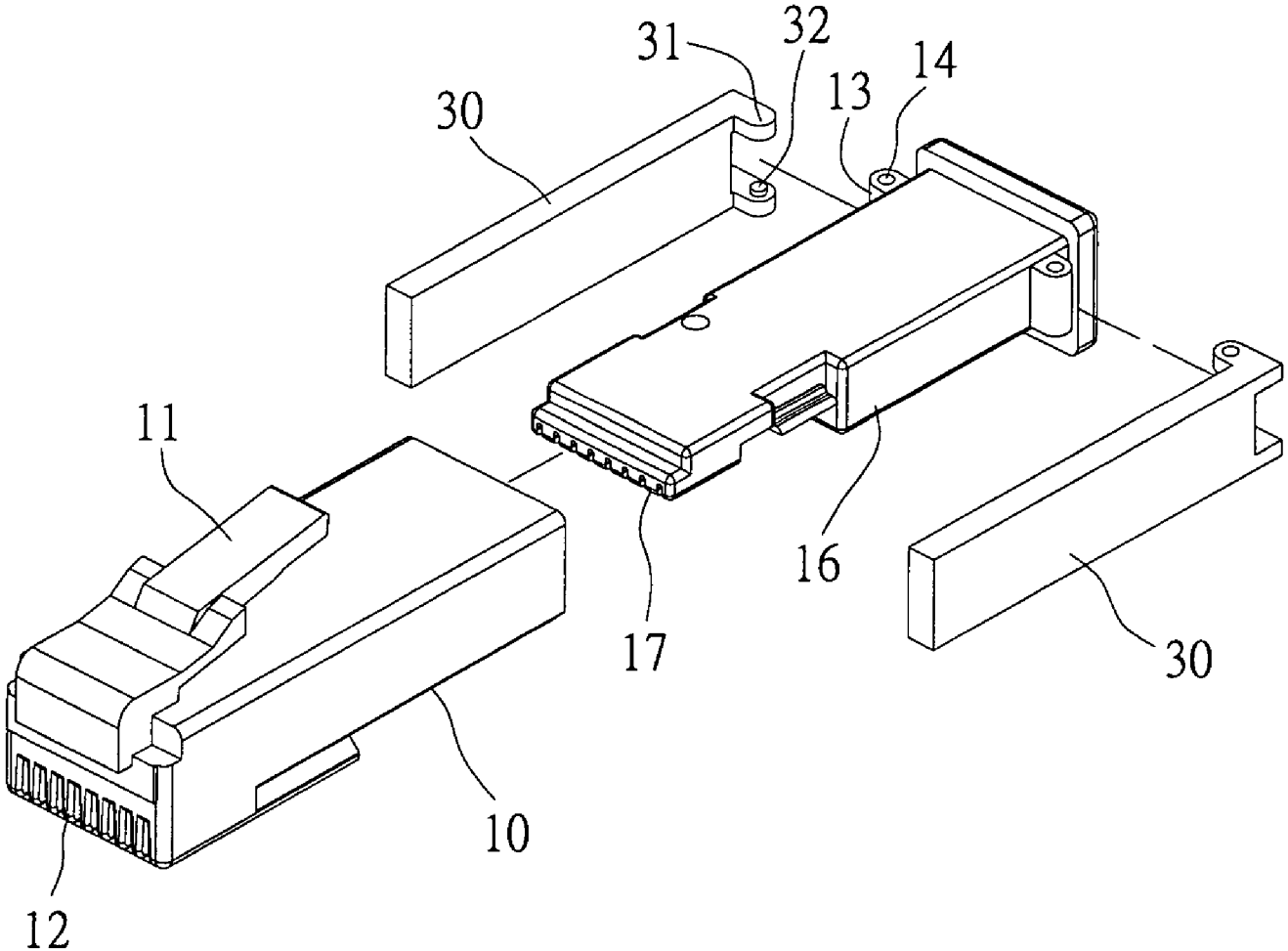
FIG. 9 is an exploded perspective view of the fourth embodiment of the present invention.

In another embodiment, as shown in FIG. 9, the two pivoting bases 13 of the present invention protrude from the two sides of the linker 16. The two transforming elements 30 are pivoted with the pivoting hole 14 of the pivoting base 13 located at the two sides of the linker 16 via the pivoting shaft 32 of the two supporting arms 31. Therefore, the two transforming elements 30 are pivoted with the two sides of the linker 16 by using a side-rotation method.

Figure 10:
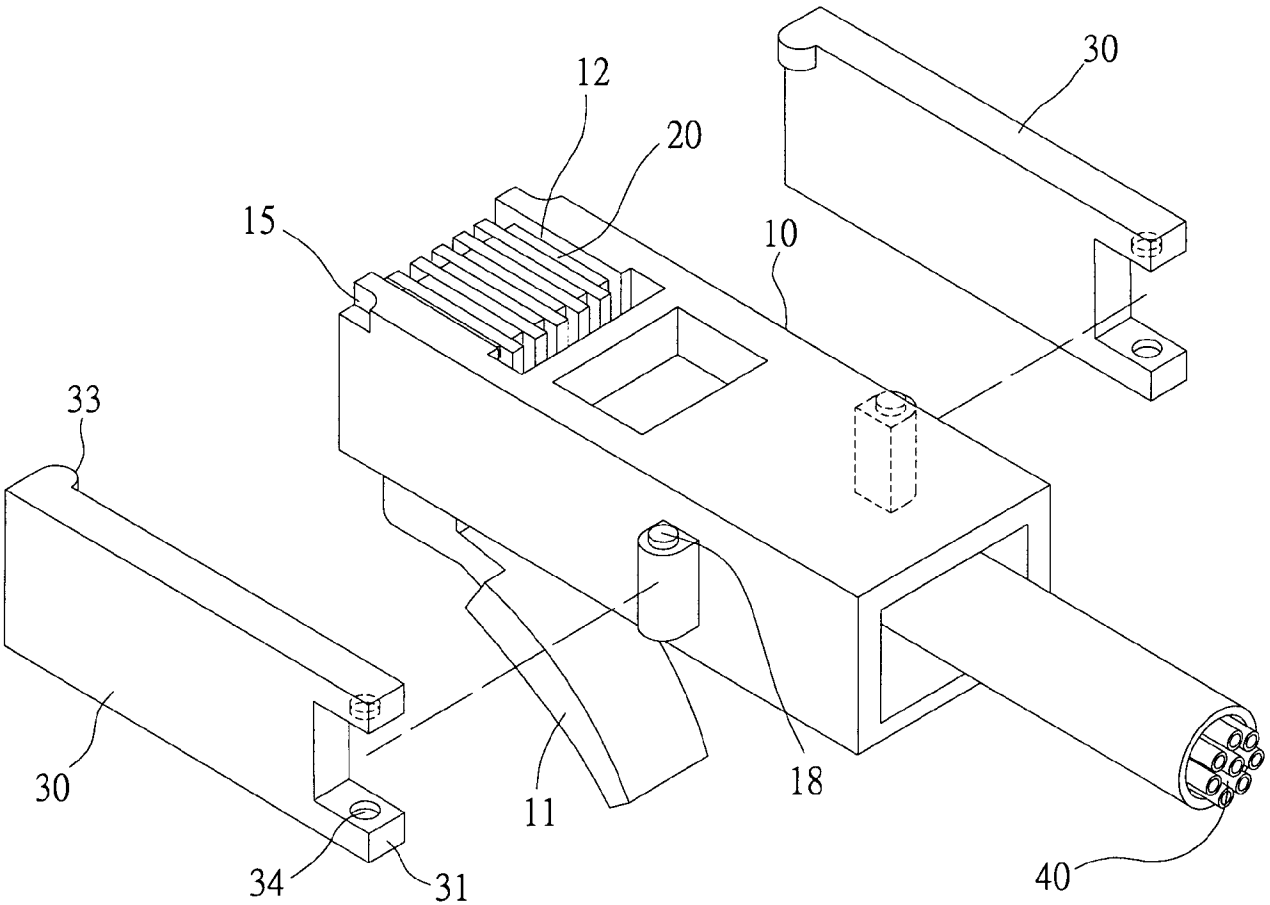
FIG. 10 is an exploded perspective view of the fifth embodiment of the present invention.

In another embodiment, as shown in FIG. 10, the present invention protrudes a pivoting shaft 18 at the rear end of the two sides of the insulating main body 10. At the rear end of the two transforming elements 30, there is a corresponding pivoting hole 34. The two transforming elements 30 are pivoted with the pivoting shaft 18 located at two sides of the insulating main body 10 via the pivoting hole 34 to make the two transforming elements 30 pivot with the two sides of the insulating main body 10 by using a side-rotation method. The two transforming elements 30 can be adjusted by using a side-rotation method according to requirements.

The description above only illustrates specific embodiments and examples of the invention. The invention should therefore cover various modifications and variations made to the herein-described structure and operations of the invention, provided they fall within the scope of the invention as defined in the following appended claims.

What is claimed is:

1. A side-rotation transforming plug, comprising:

an insulating main body having a plurality of pin slots in a front side, an inner part of the insulating main body having a linker and a plurality of conducting lines passing through an inner part of the linker, and a front part of the linker having a plurality of line slots formed therein, the conducting lines being plugged into an inner part of the line slots from a rear of the linker;

a plurality of pins located in the pin slots, the pins being pressed into the pin slots to make the pins electrically connect with the conducting lines; and two transforming elements that are side-rotated and are pivoted at two sides of the insulating main body;

wherein the two transforming elements are rotated backward so that they are located at a first position or rotated forward so that they are located at a second position, and stacked and installed at the two sides of the insulation main body, said transforming elements being displaceable for adaptive coupling to either of two different sized sockets.

2. The side-rotation transforming plug as claimed in claim 1, wherein from the two sides of the insulating main body protrude a pivoting base, and the pivoting base includes a pivoting hole that is vertical and passes through the pivoting base, and the rear side of the two transforming elements form supporting arms and the supporting arms include a pivoting shaft, wherein the two transforming elements are pivoted with the pivoting hole of the pivoting base located at the two sides of the insulating main body via the pivoting shaft of the two supporting arms.

3. The side-rotation transforming plug as claimed in claim 1, wherein the two sides of the insulating main body comprise pivoting shafts and the rear side of the two transforming elements comprise pivoting holes, wherein the two transforming elements are pivoted with the pivoting shafts of the two sides of the insulating main body via the pivoting holes.

4. The side-rotation transforming plug as claimed in claim 1, wherein a plurality of conducting lines are plugged into the rear side of the insulating main body, and the pins are electrically connected with the conducting lines.

5. The side-rotation transforming plug as claimed in claim 1, wherein a connector is linked with the rear side of the insulating main body, and the pins are electrically connected with the connector.

6. The side-rotation transforming plug as claimed in claim 1, wherein a plug is linked with the rear side of the insulating main body, and the pins are electrically connected with the plug.

7. The side-rotation transforming plug as claimed in claim 1, wherein a plughole is linked with the rear side of the insulating main body, and the pins are electrically connected with the plughole.

8. The side-rotation transforming plug as claimed in claim 1, wherein each has a first wedging-buckling part at the front side of the two transforming elements and each has a corresponding second wedging-buckling part at the front side of the two sides of the insulating main body, wherein when the two transforming elements are rotated forward so that they are stacked and located at the two sides of the insulation main body, the first wedging-buckling part is wedged and buckled with the second wedging-buckling part.

9. A side-rotation transforming plug, comprising:

an insulating main body having a plurality of pin slots in a front side, an inner part of the insulating main body having a linker and a plurality of conducting lines passing through an inner part of the linker, and a front part of the linker having a plurality of line slots formed therein, the conducting lines being plugged into an inner part of the line slots from a rear of the linker;

a plurality of pins located in the pin slots the pins being pressed into the pin slots to make the pins electrically connect with the conducting lines; and two transforming elements that are side-rotated and are pivoted at the two sides of the linker;

wherein the two transforming elements are rotated backward so that they are located at a first position or rotated forward so that they are located at a second position.

* * * * *